US005791932A

United States Patent [19]

Hasenfratz

[11] Patent Number: 5,791,932

[45] Date of Patent: Aug. 11, 1998

[54] RELEASABLE CONNECTOR ASSEMBLY

[75] Inventor: Robert Hasenfratz, Waiblingen, Germany

[73] Assignee: ITT Cannon, Inc., Santa Ana, Calif.

[21] Appl. No.: 679,636

[22] Filed: Jul. 10, 1996

[30] Foreign Application Priority Data

Jul. 18, 1995 [DE] Germany ..... 195 26 248.4

[51] Int. Cl.[6] ..... H01R 4/50

[52] U.S. Cl. ..... 439/347; 439/349

[58] Field of Search ..... 439/345, 347, 439/349, 350, 351, 923

[56] References Cited

U.S. PATENT DOCUMENTS

| | | | |
|---|---|---|---|
| Re. 19,920 | 4/1936 | Parker | 173/269 |
| 2,761,111 | 8/1956 | Klostermann | 439/349 X |
| 2,843,832 | 7/1958 | Bretthauer . | |
| 2,866,958 | 12/1958 | Postell . | |
| 3,281,757 | 10/1966 | Bonhomme | 439/349 |
| 4,671,591 | 6/1987 | Archer | 439/346 |
| 5,120,233 | 6/1992 | Mikola | 439/349 X |
| 5,123,858 | 6/1992 | Haag et al. | 439/347 |
| 5,195,904 | 3/1993 | Cyvoct | 439/349 |
| 5,639,255 | 6/1997 | Muzslay | 439/347 |

FOREIGN PATENT DOCUMENTS

| | | |
|---|---|---|
| 40 13 682 A1 | 4/1990 | Germany . |
| WO 93/08618 | 10/1992 | WIPO . |
| WO 96/10132 | 9/1994 | WIPO . |

*Primary Examiner*—Khiem Nguyen
*Attorney, Agent, or Firm*—Frelich Hornbaker Rosen

[57] ABSTRACT

A connector assembly includes a first connector (2) with a forwardly-projecting pin (18) having a groove (32), and a second connector with a sleeve (20) having a passage (21) for receiving the pin. The second connector also has a spring clip (24) that deflects into the pin groove when the connectors are mated, to resist pullout of the pin and therefore unmating of the connectors. The groove in the pin has a radially-outward forward wall portion (36) which is angled to face at least 20° from the pin axis, so that when the connectors are pulled apart, a portion of the clip lying in the pin groove can ride radially outwardly along the inclined wall to allow the connectors to be unmated. The clip is largely U-shaped with a base (72) and with bent arm free end portions (73) each lying in opposite recess portions (27, 26) of a circumferential slot (23) in the sleeve.

10 Claims, 5 Drawing Sheets

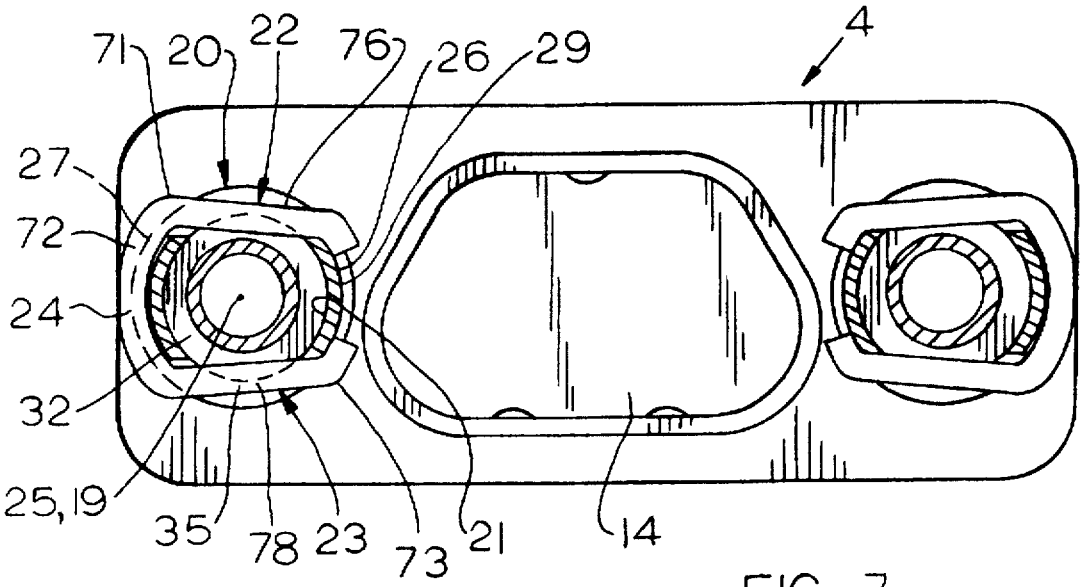
FIG. 3
FIG. 4
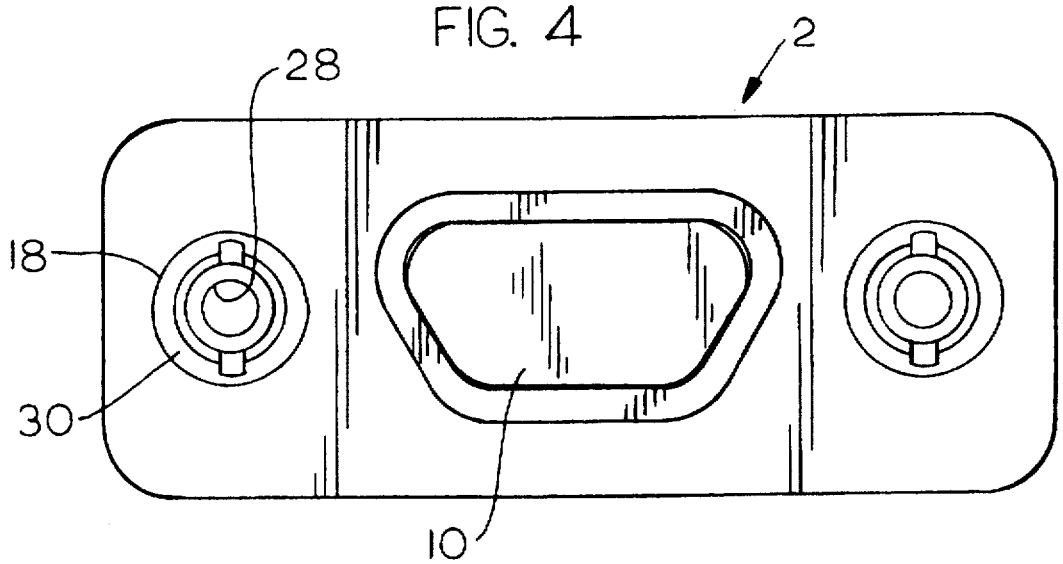

RELEASABLE CONNECTOR ASSEMBLY

BACKGROUND OF THE INVENTION

First and second connectors can be latched together by providing the first connector with a forwardly-projecting pin, and by providing the second connector with a sleeve having a passage for receiving the pin. An element on the second connector can move into a pin groove to lock the connectors together.

One type of locking element, described in DE 40 13 682 A1, is a plate-shaped sliding element that can slide transverse to the mating direction so an edge of the sliding member enters the pin groove to lock the pin in place. In another arrangement described in U.S. Pat. No. 5,639,255, the second connector includes a spring clip with a pair of arms that are biased together and that automatically deflect into the pin groove when the connectors are fully mated. In the later case, the arms can be manually spread apart to release the pin so it can be pulled out of the passage to unmate the connectors. In many applications, there is little room for mounting the spring clip, and it would be desirable if the spring clip occupied as little as possible of the connector profile, as viewed rearwardly therealong. It also would be desirable if the connectors could be mated and unmated in as simple a manner as possible.

SUMMARY OF THE INVENTION

In accordance with one embodiment of the present invention, a connector assembly is provided, of the type wherein a first connector has a forwardly projecting pin that enters a passage in a sleeve of the second connector, wherein the connectors can be latched and unlatched without complexity, in an arrangement occupying minimal space. The pin has a circumferential groove, and the sleeve has a slot through which a clip portion can project to enter the groove of the pin. The clip portion and a groove front wall are constructed so a large unmating force causes the clip portion to ride radially outwardly along the groove forward wall to allow the pin to pull out of the passage. In one arrangement, a radially outward portion of the groove forward wall faces at an incline of at least 20° from the pin axis to facilitate the clip portion riding radially outwardly along the groove forward wall.

The clip is of largely U-shape, with a pair of arms having arm inner ends that are joined by a base and having arm free outer ends. The slot in the sleeve includes a pair of through slot portions through which middle portions of the arms can pass to enter the groove in the pin. The slot also includes opposite recesses that extend only partially through the slot walls. The base of the spring clip and the free outer end portions of the arms lie in the opposite recesses, to hold the clip on the sleeve.

The clip outer end portions can be bent towards each other to lie securely in a slot recess. The base can be curved so much of it lies in the slot recess. The spring clip can be bent out of a plane in which the base lies, so one arm extends above the plane and the other arm extends below the plane, to prevent the spring clip from lying too loosely on the sleeve.

The groove in the pin can include a wide outer groove portion whose forward wall portion is inclined, and can also include an inner groove portion with a front wall portion that faces substantially along the axis. This allows a latching element to enter the inner groove portion, which will prevent separation of the connectors until the latching element is moved out of the inner groove portion. Such latching element can be a sliding element.

The novel features of the invention are set forth with particularity in the appended claims. The invention will be best understood from the following description when read in conjunction with the accompanying drawings.

BRIEF DESCRIPTION OF THE DRAWINGS

FIG. 3 is a view taken on line 3—3 of FIG. 1.

FIG. 4 is a view taken on line 4—4 of FIG. 1.

DESCRIPTION OF THE PREFERRED EMBODIMENTS

Figure 1:
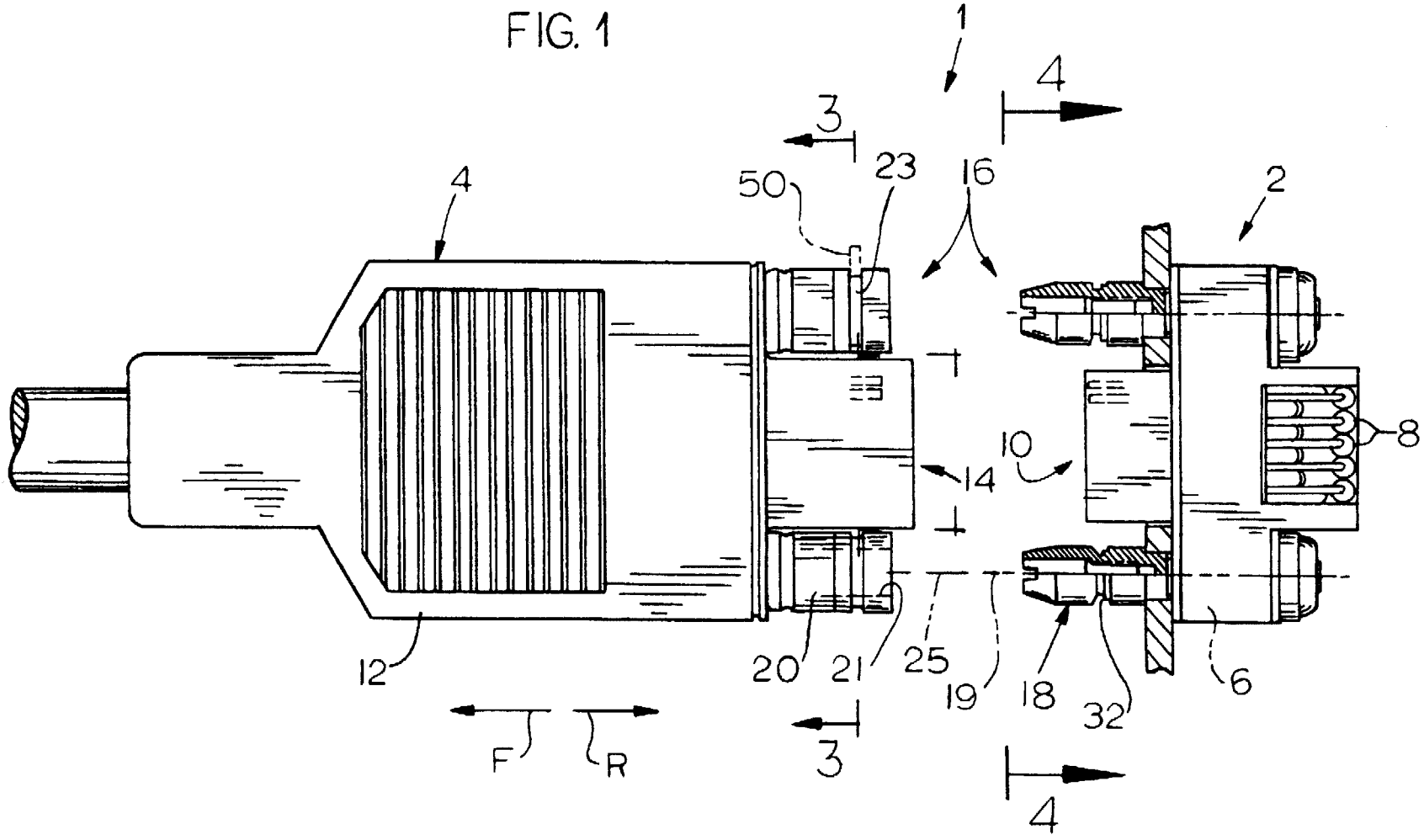
FIG. 1 is an exploded top view of a pair of connectors of the present invention, shown separate prior to mating.

FIG. 1 illustrates a connector arrangement 1 that includes a first connector 2 of the pin plug type and a second connector 4 of the socket receiver type. The first connector, or connector device 2 includes an insulative housing 6 for receiving contact wires 8 connected with a circuit board and leading to a contact arrangement 10 that includes at least one row of pin contacts. In a corresponding manner, the second connector 4 includes an insulative housing 12 that is mechanically connected to a cable with wires. The cable wires are connected to at least one row of socket contacts in a contact arrangement 14 that is designed to mate with the contact arrangement 10 of the first connector.

Figure 2:
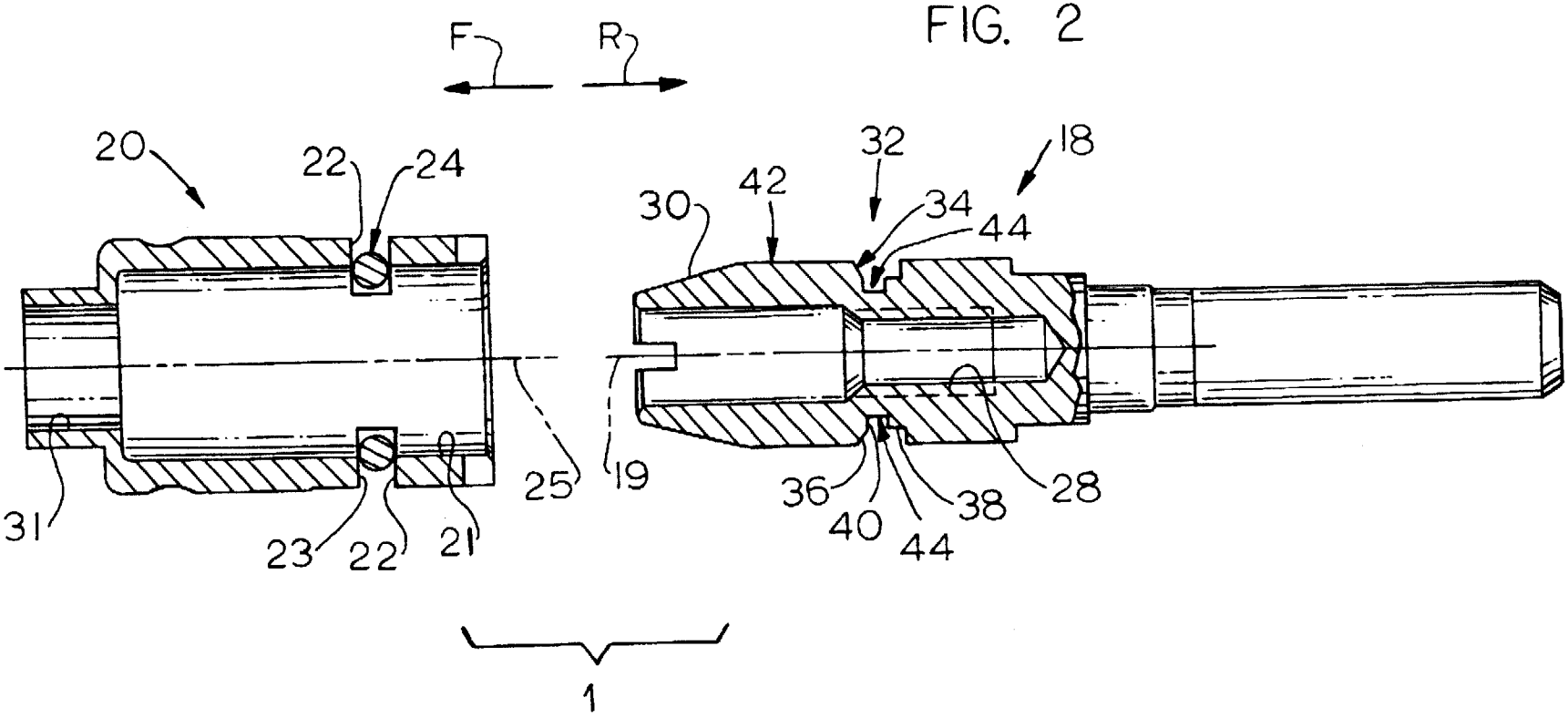
FIG. 2 is an exploded sectional view of the pin and sleeve of the connectors of FIG. 1.

A latching arrangement 16 includes a pair of pins 18 each projecting forwardly, in direction F, along a pin axis 19 toward a passage 21 in a sleeve 20 of the second connector. As shown in FIG. 2, the sleeve 20 has a largely circumferential slot 23 with two through slot portions 22 that extend through the entire thickness of the sleeve. A U-shaped spring clip 24 has arms that project through the through slot portions 22 into the passage. Each forwardly-projecting pin 18 has a circumferential (with respect to axis 19) groove 32 with a forward groove wall 34. As the pin 18 is inserted forwardly into the sleeve 20, portions of the spring clip 24 are initially separated, or deflected radially outwardly with respect to the passage axis 25 (which lies substantially coincident with the pin axis 19) by a centering tapered forward portion 30 of the pin. The radially outwardly deflected clip rides along an outer surface 42 of the pin, until the pin groove 32 reaches the spring clip 24. Arms of the spring clip then deflect into the groove 32, and the clip thereafter latches the connectors together, by resisting rearward (R) movement of the pin 18 out of the passage.

FIG. 3 shows that the spring clip 24 is largely U-shaped, with a pair of arms 76, 78 having inner ends 71 joined by a base 72 and having free outer end portions 73. The arms have middle portions 35 that project through and radially inward of the through portions 22 of the slot 23 to lie in the pin groove 32.

Figures 2A, 2B:
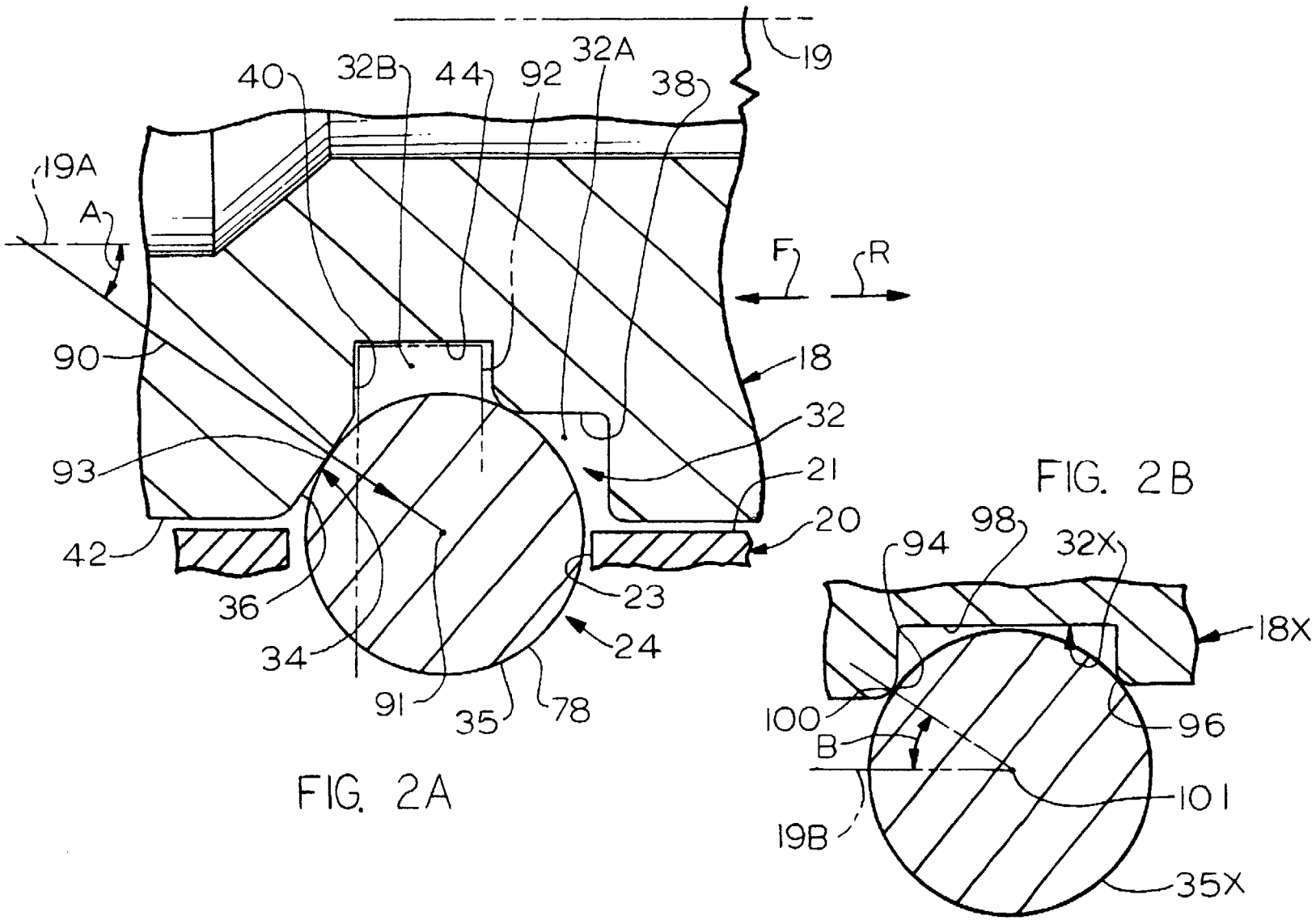
FIG. 2A is an enlarged sectional view of a portion of the connectors of FIG. 2 in a fully mated position.
FIG. 2B is a partial sectional view similar to that of FIG. 2A, but of another embodiment of the invention.

The spring clip 24 is preferably formed of wire of round cross-section. FIG. 2A shows the middle portion 35 of one spring clip arm 78 lying in the circumferential groove 32 of the pin 18. The forward groove wall 34 includes a radially outer forward wall portion 36 which faces in a direction 90 that is angled by an angle A of about 35° to the axial direction of axis 19 and to an imaginary line 19A that is parallel to the axis. It is noted that line 90 is drawn to pass through the center 91 of the clip arm portion 35 and through a location 93 of the arm that engages the forward wall. The location 93 faces opposite the direction 90. When the pin 18 is moved in the rearward direction R relative to the sleeve 20, the arm middle part 35, which cannot move rearwardly with the pin, is deflected radially outwardly along the front wall portion 36, until the arm middle portion 35 lies entirely out of the groove 32. As a result, while the clip 24 latches the two connectors together by resisting their separation, the resistance to separation can be overcome by a moderate force such as, for example, an unmating force of 7 kilograms.

The resistance to unmating depends upon the radial force required to separate the spring clip arms and the angle A along which the front wall portion 36 faces. If the angle A is much less than 20°, then friction between the arm portion 35 and the forward wall portion 36 may prevent separation, while if the angle A is more than about 70°, then there is little resistance to separation and the latching effect is minimal. Accordingly, applicant prefers that the angle A be at least about 20° (more than 15°), and preferably no more than about 70°.

It may be noted that the circumferential groove 32 in the pin has two groove portions 32A and 32B, with a radially outer bottom wall 38 and a radially inner bottom wall 44. The outer bottom wall 38 limits the depth to which the spring clip portion 35 can enter the groove, to assure that the arm rests against the inclined forward wall portion 36. The bottom wall 44 forms a narrower groove with a radially inner forward wall portion 40 that faces in the axial direction of axis 19, and which is angled by less than 20° from such direction. As a result, a locking device 92 that is of smaller width than the deepest groove portion 32B, can enter the deepest groove portion and abut the radially inner forward wall portion 40, to prevent separation of the connectors unless the locking device 92 is first manually moved out of the groove 32, or at least the inner portion thereof.

Figure 6:
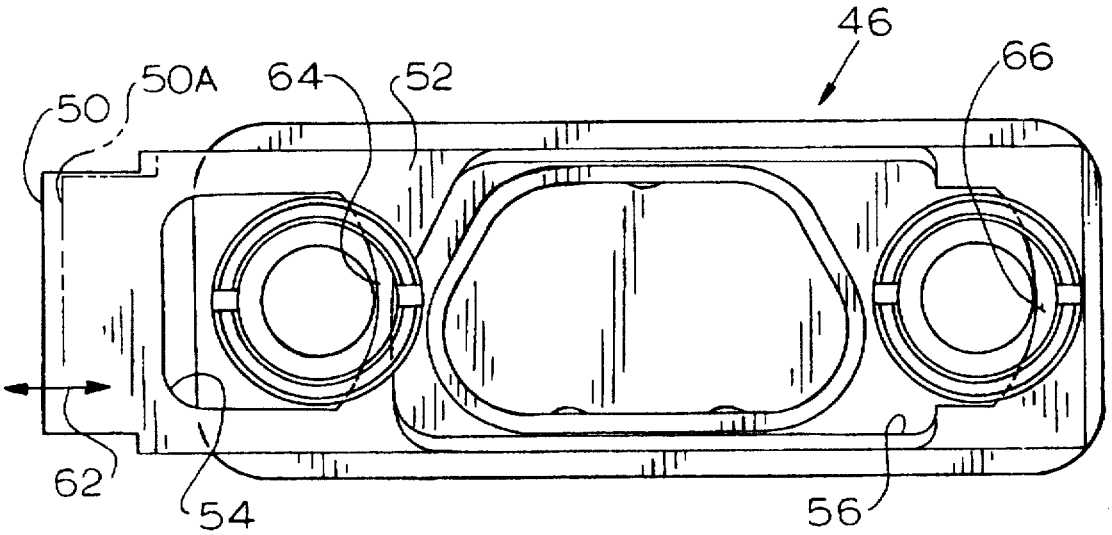
FIG. 6 is a front view of a prior art connector which can be used with the pin of FIG. 2.

FIG. 6 shows a prior art connector 46 with a slide 52 that can slide in directions 62 between an open position 50A and a locking position 50. In the locking position 50, rim areas 64, 66 of slide opening 54, 56 will enter the inner groove portion of each pin 18 (FIG. 2A) to serve as the lock element 92 to prevent separation of the connectors.

Although applicant prefers the arrangement shown in FIG. 2A, where arm middle portions 35 lie against inclined forward wall surfaces 36 of the pin, another arrangement shown in FIG. 2B can be used instead. In FIG. 2B, a pin 18X is shown with a groove 32X that has a forward corner 94 that abuts the spring clip arm middle portion 35X. The distance between the forward corner 94 and a rearward corner 96, or the depth of the slot to a bottom wall 98 that forms a clip engaging means, determines how deeply the spring clip portion 35X enters the slot. This determines the particular location 100, which forms a wall engaging means of the spring clip portion 35X that will engage the forward corner 94. The angle B between the axial direction 19B and the location 100, with respect to the center 101 of the clip portion, determines the force required to separate the connectors (in addition to other factors such as the force required to separate the spring clip arms). The angle B is preferably at least about 20°.

Referring again to FIG. 3, it can be seen that the slot 23 in the sleeve includes opposite recess portions 26, 27 on opposite sides of the sleeve axis 25 and circumferentially spaced from the through slot portions 22. The recess portions extend only partially through the sleeve and have recess bottom walls 29 lying outside the sleeve passage 21. It can be seen that the base 72 has at least a portion that lies in one of the recesses 27. Also, the free end portions 73 of the arms are bent towards each other, so they lie in the opposite recess portion 26. As a result, the spring clip 24 holds itself in position on the sleeve 20, with the clip projecting only slightly beyond the outer surface of the sleeve. This simplifies mounting of the spring clip, and results in the addition of the spring clip occupying only a small area around the sleeve.

The spring clip can be readily installed by spreading its arms and pushing it into place. As shown in FIG. 5A, the free outer end portion 73 of each clip includes a bend at 75 and a free end part 78, 80 lying at a side of the bend opposite the arm middle portion 35. The bend 75 is preferably more than 20° to enable the free end parts 78, 80 to lie securely in a sleeve recess portion, with the particular bend angle C shown being about 60°. The base 72 is curved to about the same radius of curvature as the sleeve recess, so substantially all of the base length is received in a sleeve recess portion.

Figure 5B:
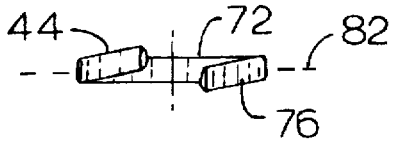
FIG. 5B is a view taken on line 5B—5B of FIG. 5A.
Figure 5A:
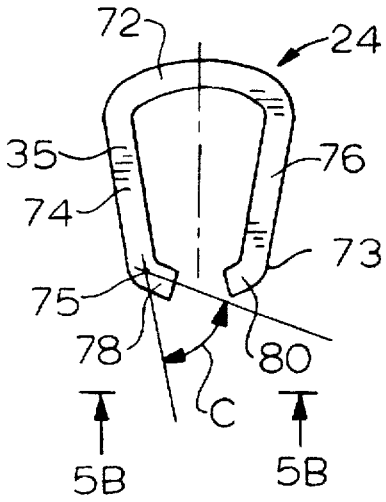
FIG. 5A is a front elevation view of the spring clip of FIG. 3.

FIG. 5B shows that while the base 72 lies in a clip plane 82, one of the arms 74 is bent upwardly out of the plane and the other arm 76 is bent downwardly out of the plane. This further helps in avoiding "rattling" of the clip when installed on the sleeve.

It is noted that although the clip 24 (FIG. 2) allows unmating of the connectors when a predetermined unmating force (e.g. 7 kgm.) is applied, the pins are also provided with a threaded portion 28. A screw projecting through a sleeve forward passage portion 31 can screw into the threaded portion to lock the connectors together.

It is noted that terms such as "upward" and "downward" are used herein only to aid in explaining the invention, and the apparatus can be used in any orientation with respect to the Earth.

Thus, the invention provides a connector assembly of the type wherein a forwardly-projecting pin on a first connector can enter a passage in a second connector, until a spring clip of the second connector deflects into a groove on the pin to latch the connectors together, which facilitates separation of the connectors and provides compact mounting of the clip. Connector separation is facilitated by constructing the spring clip and a pin groove forward wall, so moderate unmating forces cause the spring clip portions to move radially outwardly beyond the groove and allow connector separation. This can be accomplished by constructing the pin groove so a forward wall thereof which is engaged by the clip, has a radially outer portion that faces at an incline of at least about 20° from the axial direction, or by constructing a groove so a location on a clip surface that engages a forward wall of the pin groove, faces in that direction. The clip has a pair of arms with inner arm ends joined by a base and free arm outer ends, and with arm middle portions that pass into and radially inward of through portions of a sleeve slot to enter the pin groove. The sleeve slot can include opposite recesses, with a portion of the base lying in one of the recesses and with one or both free end portions of the arms being bent to lie in the opposite recess, to thereby simply and compactly mount the spring clip on the sleeve. The pin groove can have a radially inner groove portion with a rearwardly facing forward wall portion, to enable locking of connectors together so they cannot be unlocked unless the locking element is pulled out of the inner groove portion.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector that is constructed to mate with a connector device that has a forwardly projecting latching pin with a largely rearwardly-facing pin wall, wherein said connector has a sleeve with sleeve walls forming a passage with an open rear end for receiving the latching pin and with said sleeve walls forming a sleeve outside surface and a clip-holding slot, said passage having an axis extending in forward and rearward directions, said connector also including a spring clip constructed to lie in said slot and to be deflected largely radially outwardly by the latching pin during forward pin insertion into said passage and to then move radially inwardly behind the pin wall to resist rearward pin movement out of said passage, wherein:

said spring clip has first and second parallel and laterally-spaced arms with each arm having inner and outer arm end portions and with a middle arm portion therebetween, said clip also having a base joining said arm inner end portions, and said arm outer end portions forming free end parts that are free to move toward and away from each other;

said slot has at least one slot through portion extending radially between said outside sleeve surface and said passage, with said arm middle portions lying in said slot through portion;

said slot has at least two opposite slot recess portions, with said sleeve walls having recess bottom walls lying outside said passage at each of said recess portions, and with at least one of said free end parts lying in one of said slot recess portions and with at least part of said base lying in the other of said slot recess portions, to help hold said spring clip in place.

2. The connector described in claim 1 wherein:

at least said first arm outer end portion has a bend of at least 20° and has a free end part on a side of said bend opposite said arm middle portion, with said free end part lying in one of said slot recess portions.

3. The connector described in claim 1 wherein:

said slot has a pair of opposite slot through portions, each extending radially between said outside sleeve surface and said passage, with each of said leg middle portions lying in and projecting through one of said slot through portions;

said second arm outer end portion also has a bend of at least 20° and has a free end part extending at least partially toward an imaginary extension of said first arm middle portion;

said slot has at least two slot recess portions, with each of said free end parts lying in one of said slot recess portions.

4. The connector described in claim 1 wherein:

said slot has at least one slot recess portion with said sleeve walls having a slot bottom wall lying outside said passage at said recess portion and extending substantially circumferential;

said base is curved substantially about said axis so most of the length of said base lies at least partially in said slot recess.

5. A combination of a connector device that includes a forwardly-projecting latching pin and a connector that has a pin-receiving passage and a spring clip and that is designed to mate with said connector device, wherein:

said latching pin has an axis that extends in forward and rearward directions and has a primarily circumferential groove for receiving the spring clip, with said groove having a forward wall with a radially-outer wall portion that is angled to face at an incline of more than 20° from the rearward direction;

said connector includes a slide that is slidable in a direction that is substantially perpendicular to said axis, and that is positioned to enter said groove, with said slide having a latch edge portion of a width to enter said groove and abut said radially-outer wall portion.

6. A connector assembly comprising:

first and second connectors wherein said first connector has at least one forwardly projecting pin with a pin axis extending in forward and rearward directions and said second connector has a passage wall forming a pin-receiving passage with a passage axis that is substantially coincident with said pin axis;

said pin has groove walls forming a substantially circumferential groove with a forward groove wall;

said second connector has a spring clip with a clip portion resiliently biased toward a latching position wherein it lies in said groove, with said clip portion and said forward groove wall constructed to deflect said clip portion out of said groove by forces applied between them when said connectors are pulled apart;

said spring clip is of substantially U-shape with a pair of arms having inner ends connected by a base, middle arm parts, and free arm outer end portions that extend out of said groove, and with said arm middle parts each lying in said groove but being deflectable apart so they are both deflected out of said groove when said connectors are pulled apart.

7. A connector assembly comprising:

first and second connectors wherein said first connector has at least one forwardly projecting pin with a pin axis extending in forward and rearward directions and said second connector has a passage wall forming a pin-receiving passage with a passage axis that is substantially coincident with said pin axis;

said pin has groove walls forming a substantially circumferential groove with a forward groove wall;

said second connector has a spring clip with a clip portion resiliently biased toward a latching position wherein it lies in said groove, with said clip portion and said forward groove wall constructed to deflect said clip portion out of said groove by forces applied between them when said connectors are pulled apart;

said clip is of substantially U-shape with a base, and with a pair of arms having inner ends joined by said base and having free outer end portions;

the free end portions of said arms are bent toward each other, but are sufficiently separated to enable installation of said clip by bending said arms apart without substantially permanently deforming said clip.

8. A connector assembly comprising:

first and second connectors wherein said first connector has at least one forwardly projecting pin with a pin axis extending in forward and rearward directions and said second connector has a passage wall forming a pin-receiving passage with a passage axis that is substantially coincident with said pin axis;

said pin has groove walls forming a substantially circumferential groove with a forward groove wall;

said second connector has a spring clip with a clip portion resiliently biased toward a latching position wherein it lies in said groove, with said clip portion and said forward groove wall constructed to deflect said clip portion out of said groove by forces applied between them when said connectors are pulled apart;

said clip is substantially U-shape with a base, and with a pair of arms having inner ends joined by said base and having free outer end portions;

said clip is formed from wire, with said base lying in a clip plane;

one of said arms of the spring clip is bent downward out of the clip plane and the other is bent upward out of the clip plane.

9. A combination of a connector device that includes a forwardly-projecting latching pin and a connector that has a pin-receiving passage and a spring clip, where said connector device is designed to mate with said latching pin, wherein:

said latching pin has an axis that extends in forward and rearward directions and has a primarily circumferential groove for receiving the spring clip, with said groove having a forward wall with a radially-outer wall portion that is angled to face at an incline of more than 20° from the rearward direction;

said connector includes a sleeve forming said passage, with said sleeve having a slot extending substantially circumferential to said axis, and with a spring clip of substantially U-shape with a base and opposite arms with said arms lying in said slot, and with said clip formed of wire of substantially round cross-section of a predetermined diameter equal to the cross-sectional diameter of each of said arms;

said groove has a groove portion of a width to receive said wire of said clip and allow said wire to lie against said radially outer wall portion of said forward wall groove portion.

10. A connector device that includes a forwardly-projecting latching pin and that is constructed to mate with a connector that has a pin-receiving passage and a spring clip, wherein:

said latching pin has an axis that extends in forward and rearward directions and has a primarily circumferential groove for receiving the spring clip, with said groove having a forward wall with a radially-outer wall portion that is angled to face at an incline of more than 20° from the rearward direction;

said groove has a radially outer first groove portion having a first bottom wall (38), and said groove has a radially inner second groove portion (32B) having a second bottom wall (44) that lies closer to said axis than said first bottom wall;

each groove portion has a forward wall portion with said first groove portion forming said wall portion (34) that is angled to face an incline (A) of more than 20°, and with said second groove portion forming a forward wall portion (40) that is inclined to face in a direction that is angled by less than 20° to said axis.

* * * * *